US005881471A

United States Patent [19]

Kaluza

[11] Patent Number: 5,881,471

[45] Date of Patent: Mar. 16, 1999

[54] METHOD AND APPARATUS FOR MAKING WINDOW TREATMENTS INCLUDING SWAGS, VALANCES AND JABOTS

[76] Inventor: Barbara K. Kaluza, 126 McCabe Dr., Streamwood, Ill. 60107

[21] Appl. No.: 708,834

[22] Filed: Sep. 9, 1996

[51] Int. Cl.[6] ..... G01B 3/14; A41H 3/00

[52] U.S. Cl. ..... 33/563; 33/13

[58] Field of Search ..... 33/562, 563, 565, 33/566, 11, 12, 13, 564; D10/64; D19/39

[56] References Cited

U.S. PATENT DOCUMENTS

| | | | |
|---|---|---|---|
| 105,355 | 7/1870 | Miller | 33/13 |
| 297,570 | 4/1884 | Chenivesse | 33/13 |
| 778,464 | 12/1904 | Specht | 33/13 |
| 1,168,803 | 1/1916 | Havrilla | 33/13 |
| 3,369,303 | 2/1968 | Henry | 33/563 |
| 3,399,711 | 9/1968 | Stulac et al. . | |
| 3,545,085 | 12/1970 | Stewart | 33/12 |
| 4,157,775 | 6/1979 | Soto . | |
| 4,960,161 | 10/1990 | Easley . | |
| 5,074,348 | 12/1991 | Phillips . | |
| 5,094,006 | 3/1992 | Varney | 33/563 |
| 5,144,997 | 9/1992 | Marasco et al. . | |
| 5,361,821 | 11/1994 | Barone . | |

FOREIGN PATENT DOCUMENTS

| | | | |
|---|---|---|---|
| 20611 | 2/1895 | United Kingdom | 33/12 |

*Primary Examiner*—Diego Gutierrez
*Assistant Examiner*—Andrew Hirshfeld
*Attorney, Agent, or Firm*—Meroni & Meroni

[57] ABSTRACT

A template used for making decorative window treatments such as swags, valances, jabots, and window treatment accessories, the template comprises a sheet of material, the sheet of material having first and second spaced curved rows of perforations, the first curved row of perforations being positioned above the second curved row of perforations with the second curved row of perforations being longer in length than the first curved row of perforations, the first and second curved rows of perforations being spaced apart and being curved in a downwardly direction, a pair of straight connecting rows of perforations having equal lengths are positioned on the sheet of material to intersect opposite ends of the spaced curved rows of perforations, each of the straight connecting rows of perforations comprising a plurality of equally spaced slots, the pair of straight connecting rows of perforations extending in a direction away from each other and down from the first curved row of perforations to the second curved row of perforations, therefore allowing a user to place the template onto a sheet of material and mark desired points onto the sheet of material to allow the user to create at least one swag or a jabot with the sheet of material.

14 Claims, 14 Drawing Sheets

METHOD AND APPARATUS FOR MAKING WINDOW TREATMENTS INCLUDING SWAGS, VALANCES AND JABOTS

BACKGROUND OF THE INVENTION

1. Field of the Invention

The present invention relates generally to an ornamental window treatment. More specifically the present invention relates to making and installing swags, jabots, valances in decorative arrangements that are easy to install and remove, and are also adjustable to suit a variety of styles and window sizes.

2. Description of the Prior Art

Ornamental window treatments such as swags, valances and jabots are popular in decorating windows in residences and commercial buildings. Such window treatments can include one or more swags that drape down from a top support such as a curtain rod and can have jabots that hang at each end to provide a decorative treatment of a window. The swags may overlap one over the other or a center swag overlaps swags on adjacent sides. In other words, the swags can overlap in line either from left to right or right to left. The jabots may overlap the swags or extend from under the swags.

Such window treatments are typically custom made and require a specialist to construct the swags as well as arrange a particular style. Additionally, these window treatments cannot be easily removed and therefore are difficult to wash. The styling and installation required to create a custom valance is a fairly complex matter and typically requires years of experience as well as trial and error in order to provide a decorative window treatment using swags and jabots. Furthermore, such custom made window treatments can be very expensive since they need to be custom made.

Designing swags is often a difficult task since often times swags are cut out from material by a trial and error method until the desired size swag is achieved. This may lead to unnecessary material being cut away and therefore the task of even making a swag can be time consuming and extremely difficult. Various templates for making swags have been proposed, however, such templates tend to have complex shapes and curves making it difficult for and ordinary user to utilize. Even after the swag material has been cut to shape, it is then a time consuming job to form the traditional swag pattern and to sew it into proper shape.

These and other types of swags and window treatments disclosed in the prior art do not offer the flexibility and inventive features of my method and apparatus for making window treatments such as swags, valances and jabots. As will be described in greater detail hereinafter, the method and apparatus for making window treatments of the present invention differs from those previously proposed.

It is therefore an object of the present invention to provide an easy-to-use template that would allow anyone to quickly create custom made swags, valances, jabots and window treatment accessories to suit any width or size of window.

It is also an object of the invention to provide a system that makes it easy for the user to install and remove such decorative window treatments in order to allow the user to wash, replace, move or re-design the window treatment arrangement.

Another object of the present invention is to provide an easy method of attaching and installing swags, jabots, valances and window treatment accessories on any type of a window.

SUMMARY OF THE INVENTION

According to my present invention I have provided a template used for making decorative window treatments such as swags, valances, jabots, and window treatment accessories, the template comprises a sheet of material, the sheet of material having first and second spaced curved rows of perforations, the first curved row of perforations being positioned above the second curved row of perforations with the second curved row of perforations being longer in length than the first curved row of perforations, the first and second curved rows of perforations being spaced apart and being curved in a downwardly direction, a pair of straight connecting rows of perforations having equal lengths are positioned on the sheet of material to intersect opposite ends of the spaced curved rows of perforations, each of the straight connecting rows of perforations comprising a plurality of equally spaced slots, the pair of straight connecting rows of perforations extending in a direction away from each other and down from the first curved row of perforations to the second curved row of perforations, therefore allowing a user to place the template onto a sheet of material and mark desired points onto the sheet of material to allow the user to create at least one swag and/or a jabot or a segment of a valance with the sheet of material.

Another feature of my invention concerns the template described above wherein the template further comprises a third curved row of perforations, the third curved row of perforations being positioned slightly below the first curved row of perforations and above the second curved row of perforations, the third curved row of perforations being shorter in length than the first curved row of perforations, the third curved row of perforations being spaced apart from the second curved row and being curved in a downwardly direction, a second pair of straight connecting rows of perforations having equal lengths being positioned on the sheet of material to intersect opposite ends of the second and third curved rows of perforations, each of the second pair of straight connecting rows of perforations comprising a plurality of equally spaced slots, the second pair of straight connecting rows of perforations extending in a direction away from each other and down from the third curved row of perforations to the second curved row of perforations, whereby a user can create a different sized swags with a sheet of material.

Yet another feature of my invention relates to the template described earlier wherein the template further comprises a third straight connecting row of perforations, the third straight connecting row of perforations being positioned a predetermined distance next to a first row of the pair of straight connecting rows of perforations, the third straight connecting row of perforations being equal in length and have the same angle as a second row of the pair of straight connecting rows of perforations, wherein the third straight connecting row of perforations extends in a direction upward and away from the first row, whereby a user can create additional window treatments and accessories with the template.

Still another feature of my invention concerns the template described earlier wherein the template further comprises a third curved row of perforations, the third curved row being positioned centrally below the first and third straight connecting rows, the third curved row being curved in a downwardly direction, wherein the third curved row and the first and third straight connecting rows allow a user to mark points on a piece of fabric and create a rosette with a bell as an accessory to a window treatment.

A still further feature of my invention relates to the template describe earlier wherein the template further comprises a third straight connecting row of perforations, the third straight connecting row of perforations being positioned a predetermined distance next to a first row of the pair of straight connecting rows of perforations, the third straight connecting row of perforations being equal in length and have the same angle as a second row of the pair of straight connecting rows of perforations, wherein the third straight connecting row of perforations extends in a direction upward and away from the first row, and a first and second jabot connecting point, the first jabot connecting point being positioned a predetermined distance away from the third straight connecting row of perforations at angle perpendicular to an uppermost slit in the third straight connecting row of perforations, the second jabot connecting point being positioned a predetermined distance away from the third straight connecting row of perforations at an angle perpendicular to a lowermost slit in the third straight connecting row of perforations, the first jabot connecting point being a longer distance from the third straight connecting row of perforations than the second jabot connecting point, whereby a user can create decorative jabots.

A further advantage of my invention relates to the template described above wherein the template further comprises a U-shaped curved row of perforations, the U-shaped curved row being positioned in between the first and second spaced curved rows of perforations and in between the pair of straight connecting rows of perforations, whereby a user can create a filler apron as an accessory to a window treatment.

An even further object of my invention concerns the earlier described template wherein the template further comprises four hardware cover points, the hardware cover points being positioned in between the first and second spaced curved rows of perforations and in between the pair of straight connecting rows of perforations, the four hardware cover points being sized in the shape of a rectangle, wherein the four hardware cover points allow a user to cut a piece of fabric for providing a decorative appearance to a hardware cover for use with window treatments.

Yet a still further feature of my invention relates to the template described above, wherein the template is made of a material selected from the group comprising of: plastic, transparent plastic, fabric, vinyl, and paper.

Still another feature of my invention concerns the template described above, wherein the straight connecting rows of perforations have alternating configurations comprising equally spaced circular shapes and equally spaced elongated slotted shapes.

According to important features of my invention I have also provided a template as described above, wherein the template is arranged to form part of a cutting machine assembly.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
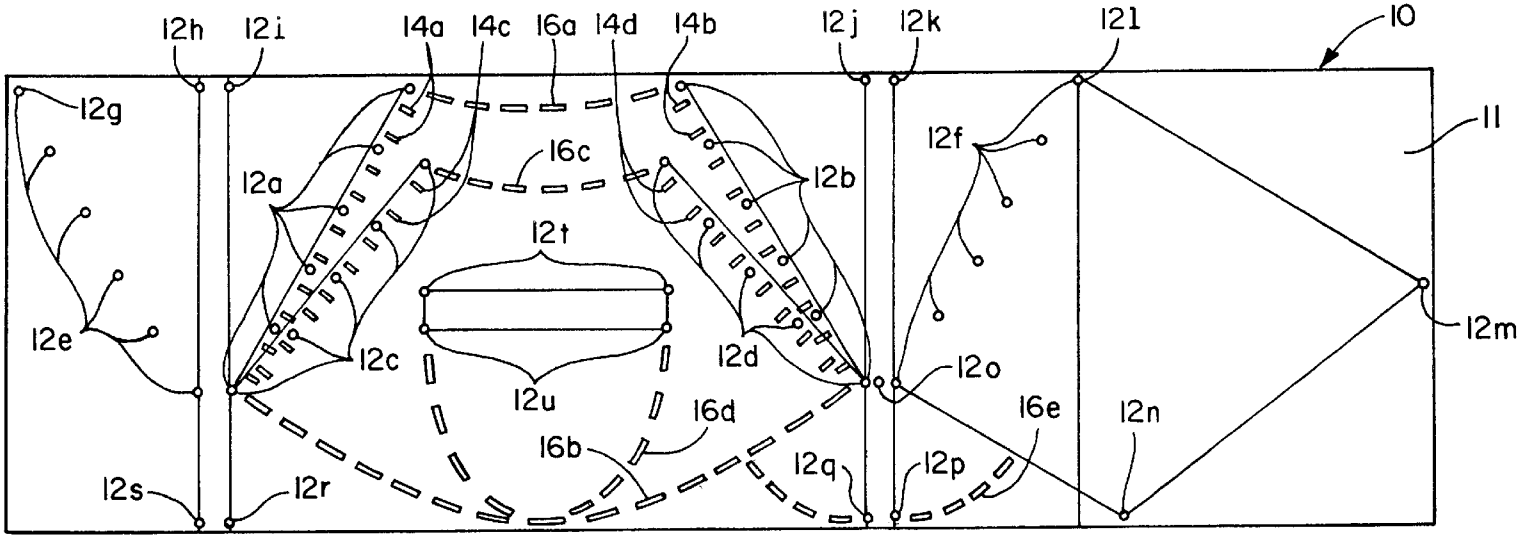
FIG. 1 is a top plan view of a template used for making window treatments and window treatment accessories embodying important features of my invention.

Referring now to the drawings, FIG. 1 shows my new and improved template 10 used for making multiple different decorative fixtures such as window treatments like swags, valances, jabots, rosettes with or without bells, filler aprons and filler hardware covers. A brief description of these window treatments is as follows: a swag is a top treatment used over draperies or blinds, or it can be used alone (e.g. FIG. 35); a valance is a horizontal decorative fabric treatment used at the top of draperies to screen hardware and cords (e.g. FIG. 37); a cascade is a fall of fabric that descends in a zigzag fashion from a drapery heading or top treatment (e.g. right side of FIG. 35); a jabot is a decorative vertical end of an over treatment that finishes a horizontal window treatment (e.g. right side of FIG. 22); a rosette is a decorative rose shaped fixture used as an additional accessory with fabric treatments, usually in-between swags (e.g. FIG. 51); a rosette with a bell is a decorative fixture used as a part of a decorative fabric treatment (e.g. FIG. 45); a filler apron is a straight piece of material used to fill open spaces between decorative fabric treatments such as a swag or valance and the existing hardware for additional decorative appearance (e.g. FIG. 49); and a filler hardware cover is a piece of rounded plastic used for shower curtains that is covered with material and is used for the purpose of covering exposed hardware in-between decorative fabric treatments such as swags and valances (e.g. FIG. 47).

The template 10 is preferably flat sheet of material 11 having a rectangular shape and is preferably constructed of a durable, transparent plastic. The transparent quality of the template allows for easy location of desirable patterns on the material that is being used to make a window treatment as well as any previously made tracings already made on the material as well as being able to use both sides of the template. The template can also be made of a variety of other materials such as plastic, vinyl, fabric or paper. Additionally, swags, valances, jabots, bells, rosettes, filler aprons and hardware covers can be made from a variety of materials such as fabric, plastic, vinyl, paper, etc., therefore the template can be used on each of these materials. The template can also be in various sizes to accommodate larger or smaller window treatments.

The template has a plurality of perforations or slits for tracing connection points 12*a*–12*u*, incision slits 14*a*–14*d*, and cutout lines 16*a*–16*e*. Connection points are used for the formation of final pleats in swags, valances, jabots, rosettes by connecting the points together. Incision points are additional points that can be used for making incisions on the material for direct installation on a window curtain rod. Cutout lines are used to cut out the traced template out of the material desired to be used to create a window treatment. The cutout lines on the template are a set of curved rows of perforations or elongated slits 16*a*, 16*b*, 16*c*, 16*d*, 16*e* that are used to create any number of window treatments.

The connection points and incision slits for creating a single swag form a pair of straight connecting rows 12*a*, 12*b*, which have equal lengths of elongated slits 14*a*, 14*b*. The pair of straight connecting rows intersect opposite ends of the spaced curved rows of elongated slits 16*a*, 16*b*. These pair of straight connecting rows extend in a direction away from each other and down from the first curved row of elongated slits to the second curved row of elongated slits. The connection points comprise a plurality of equally spaced circular shapes 12*a*, 12*b* and the incision slits comprise a plurality of equally spaced slotted shapes 14*a*, 14*b*. The circular shapes and slotted shapes help the user in constructing the swag from the material wherein the circular shapes are used as connecting points for creating pleats and the slotted shapes allow the user to make incisions at that particular location to allow the swag to be slid onto a curtain rod or the like. The slotted shapes can also be used as connection points wherein each of the points made from the slotted shapes can be connected together to form a decorative pleated swag.

Even though this template makes it extremely easy for a user to create a decorative window treatment, this template, or only even a portion of this template, can also be used to form part of a cutting machine assembly, thereby allowing this template to be used in a large production scale as well.

A single template can be used to create a wide variety of applications, sizes and appearances of swags, valances, jabots and accessories such as rosettes with or without bells, filler aprons and filler hardware covers. To create a traditional swag, the connection points or incision points, and the cutout lines are traced onto a sheet of material. The material can be traced or marked using a variety of marking implements such as marker, pencil, chalk, or whatever may be suitable for the particular piece of material being used. After the sheet of material is marked from the template, the swag or desired window treatment is cut out from the material using the cutout lines and a straight line border just outside of the connections points so the connection point markings and the incision point markings are still showing. At that point the connection points or incision points are attached to each other by a variety of different means thereby creating a swag with nicely pleated folds along the length of the material If so desired, a swag or valance can be created with only a rectangular piece of material without cutting the material to a specific shape. To accomplish this, one must trace the connection points onto the rectangular piece of material and connect the connection points.

The template 10 allows for one to create two different types of swags, one type is taken along connection points 12*a* and 12*b*, and another type is taken along connection points 12*c* and 12*d*. This allows a user to create a larger variety of different types of window treatments.

The template 10 further allows one to create a valance by shifting the template over a long rectangular piece of material sized approximately the width of the template. To create a valance, for example, connection points 12*a*, 12*b*, and 12*e* would be traced on to the valance material and then the template would be shifted in such a fashion so that the points marked from connection points 12*e* would now be located underneath connection points 12*b*. At that point connection points 12*a* would then be traced on to the valance material. One can then create as long of a valance as desired.

Using connection points 12*f*, 12*m*, and 12*n* on the template 10 allows a user to create a jabot. The connection points are marked onto the fabric and the fabric is cut out along the outer edges of the connection points. In order to create ajabot, one only needs to connect each of connection points 12*f* together.

All of the connection points, incision points, and elongated slits situated on the template 10 can be determined by creating a perfected swag with a sheet of material. The perfected swag can then be used as a guide in creating the appropriate connection points, incision points and elongated slits on the template. In order to create a perfected swag, one may need to create the swag using trial and error until a perfected swag is created, or an existing perfected swag can also be used. The particular shapes of the connection points, incision slits, and elongated slits are arbitrary and can be of a variety of different types of shapes as long as the connection points, incision slits, and elongated slits can be differentiated.

The template 10 allows for the creation of further accessories for window treatments such as rosettes with or without bells, filler aprons and hardware filler covers. The creation of these accessories will be described in more detail later on in this application.

Figure 2:
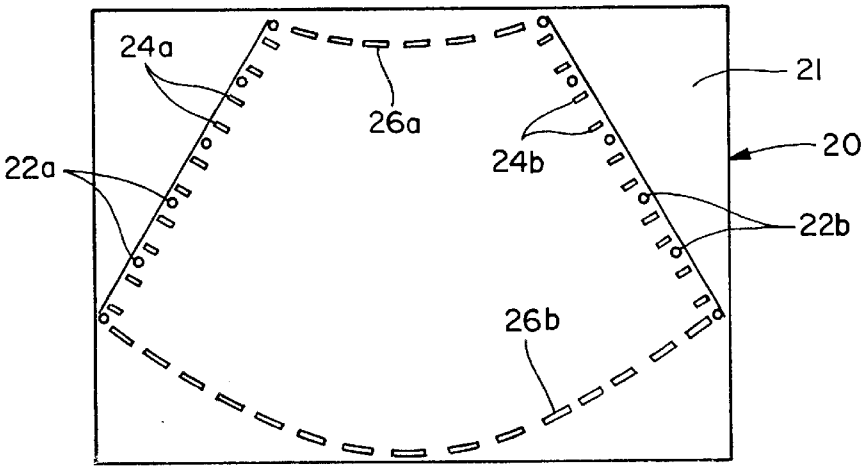
FIG. 2 is a top plan view of another template used for making window treatments.

The template 10 of FIG. 1 allows one to create numerous different window treatments and accessories. Referring to FIG. 2, this template 20 is a more simplified version of FIG. 1. The simplified template 20 is also made of a material 21 similar to the template 10 of FIG. 1. The template 20 includes connection points 22*a* and 22*b*, incision points 24*a* and 24*b* and cutout lines 26*a* and 26*b*. This template 20 still allows a user to create swags, valances, cascades, and jabots as well as rosettes and rosettes with bells. More specific examples using this template 20 will be described with the description of the additional Figures.

Figure 4:
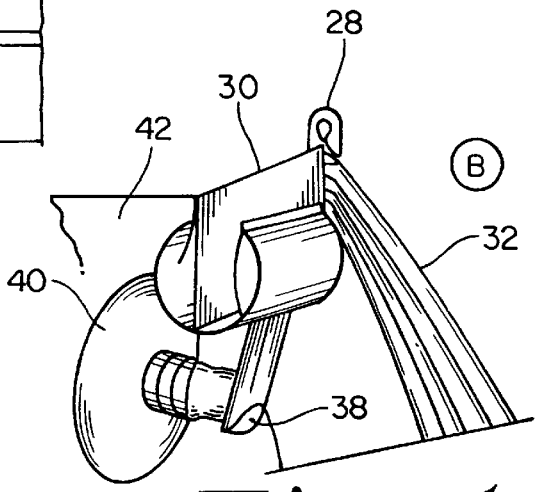
FIG. 4 is a partial side view illustrating another method of attaching a window treatment of the present invention.
Figure 7:
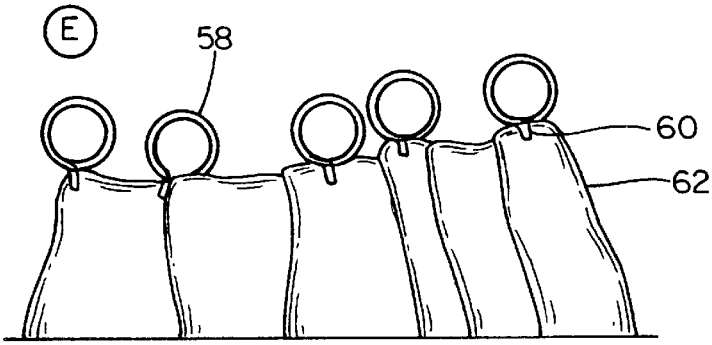
FIG. 7 is a partial front view illustrating the use of café clips attached to individual connection points used in attaching a window treatment of the present invention.
Figure 8:
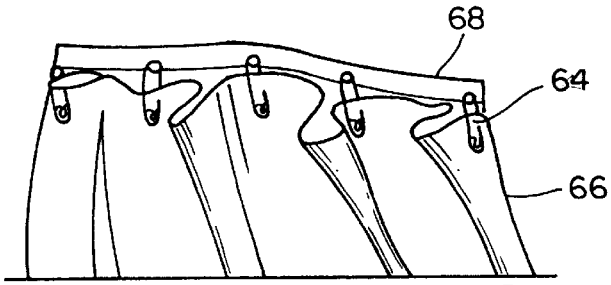
FIG. 8 is a partial front view illustrating yet another method of attaching a window treatment using safety pins to a connection strip.
Figure 9:
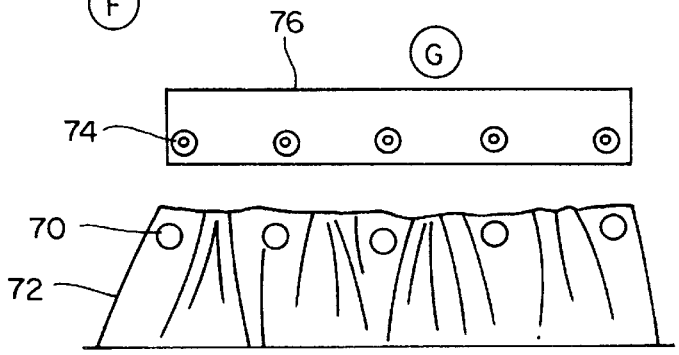
FIG. 9 is a partial front view of a still further method of attaching a window treatment using snap buttons.
Figure 10:
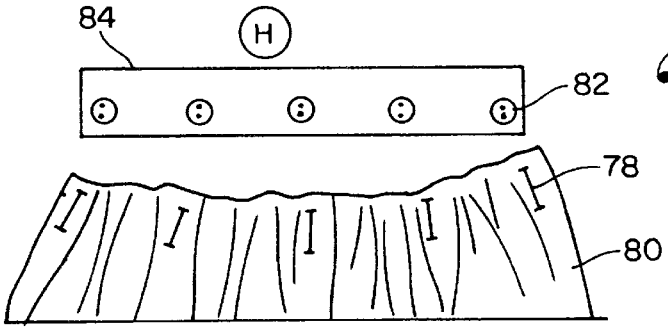
FIG. 10 is a partial front view similar to FIG. 9 illustrating the use of buttons.
Figure 11:
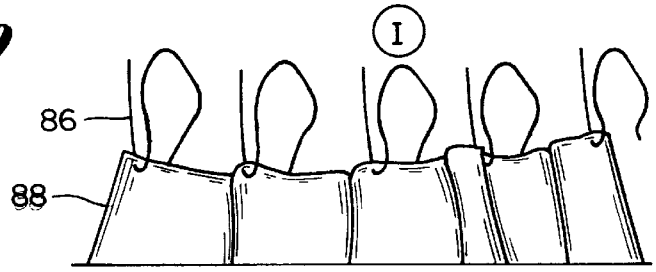
FIG. 11 is a partial front view illustrating yet another method of attaching a window treatment of the present invention using pin-on hooks at each connection point.
Figure 12:
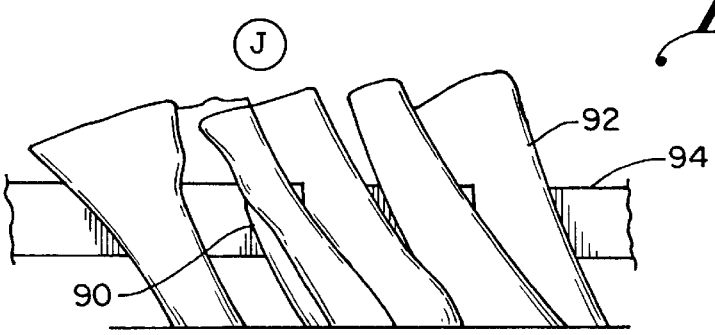
FIG. 12 is a partial front view showing still a further method of attaching a window treatment of the present invention by sliding the material onto a curtain rod through predetermined slits on the material.

The different means of attaching the connection points together and onto a window treatment includes the following:

A) Using a safety pin 28 (FIG. 3, 52, 53) with a piece of hook and loop fastener material 30 attached to the safety pin to connect and hold marked connection points on a piece of fabric 32 and then attach the hook and loop fastener material 30 to a back side of a curtain rod 34 having an opposing hook and loop fastener material 36 attached thereon;

B) Using a safety pin 28 (FIG. 4) attached to a piece of hook and loop fastener material 30 (or any other firm piece of material) to connect and hold marked connection points on a piece of fabric 32 and then placing the firm piece of material 30 into a binding clip 38 having a suction cup 40 that is attached to a blind-shade rod, dauphin rod, or any smooth surface 42;

C) Using a safety pin 44 (FIG. 5) to connect and hold marked connection points on a piece of fabric 46 and then placing the safety pin 44 onto a binder clip 48 that is clipped to a curtain rod 50;

D) Using a pin-on hook 52 (FIG. 6) to connect and hold connection points 54 on the fabric 56 together and then placing the pin-on hook 52 onto a curtain rod or the like, the connection points can either be pierced by the hook directly through the fabric or each individual point can be tacked with thread thereby allowing one to pierce the hook through the tacked thread located at each connection point;

E) Attaching clips, such as café clips 58 (FIG. 7), to each individual connection point 60 on a piece of fabric 62, and sliding the cafe clips 58 onto a curtain rod;

F) Attaching safety pins 64 (FIG. 8) to each individual connection point on a piece of material 66 and then attaching each safety pin to a fastener strip 68 for attachment to a curtain rod or the like;

G) Attaching snap buttons 70 (FIG. 9) onto each connection point on a piece of material 72 and attaching the opposing snap buttons 74 to a fastener strip 76 for attachment to a curtain rod or the like;

H) Making button holes 78 (FIG. 10) at each connection point on a piece of material 80 and attaching the window treatment material to buttons 82 attached on a fastener strip 84 for placement onto a curtain rod or the like;

I) Attaching pin-on hooks 86 (FIG. 11) to each individual connection point on a piece of material 88, and then attaching each pin-on hook 86 onto a curtain rod or the like; and J) Making slit cuts 90 (FIG. 12) into each incision point marked on a piece of material 92, and then sliding a curtain rod 94 through each of the slit cuts 90 (the slit cuts may need to be created in the same fashion as button holes are created).

Figure 3:
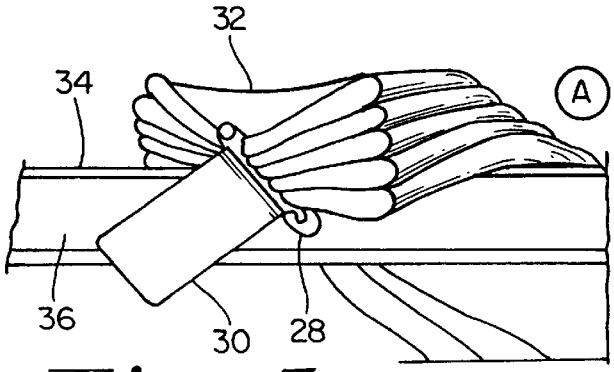
FIG. 3 is a partial rear view illustrating the attachment of a window treatment to a curtain rod using a hook and loop fastener.
Figure 5:
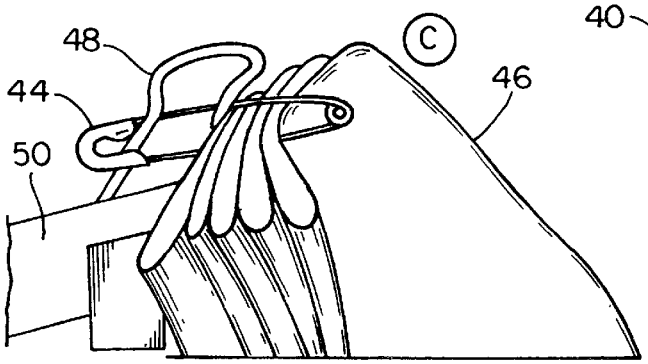
FIG. 5 is a partial side view of yet another method of attaching a window treatment.
Figure 6:
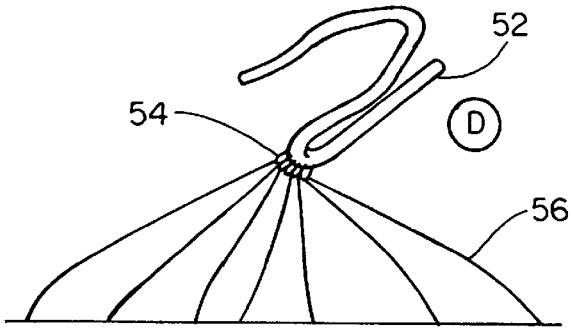
FIG. 6 is a partial front view of a further method of attaching a window treatment using a standard pin-on hook to connect and hold connection points together.
Figure 13:
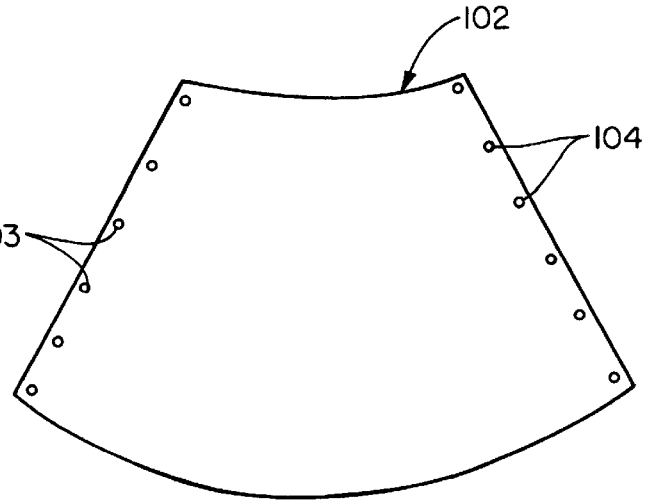
FIG. 13 is a top plan view of a piece of material formed using the template of the present invention.
Figure 14:
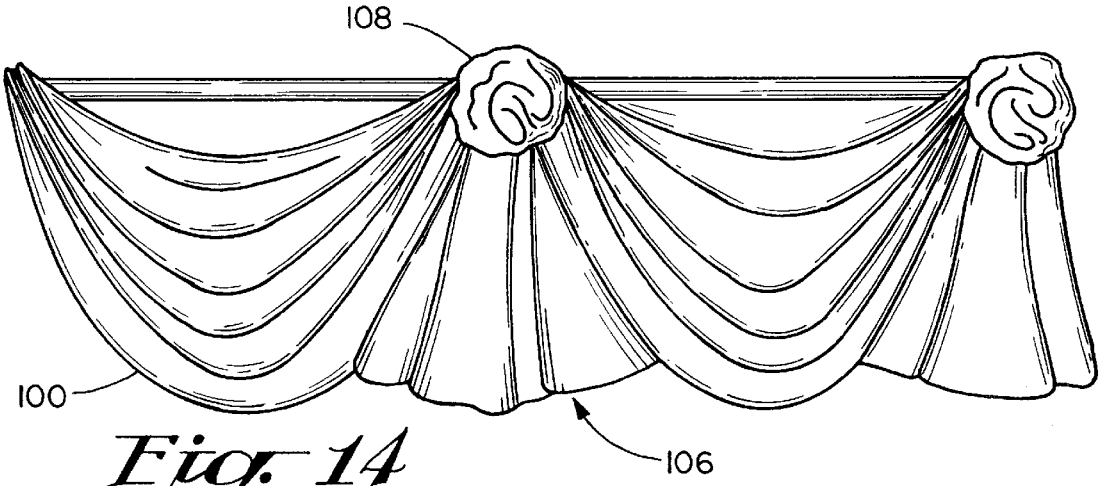
FIG. 14 is a front elevational view of a window treatment created using two pieces of material identical to FIG. 13 with added accessories of two rosettes with bells.

FIGS. 13 and 14 illustrate the creation of a traditional type of swag 100 that can be created using a form 102 created from the templates 10, 20 (FIGS. 1 and 2) by using points 12*a*, 12*b*, 16*a*, and 16*b* from template 10 in FIG. 1; or points 22*a*, 22*b*, 26*a*, and 26*b* from template 20 in FIG. 2. These points are marked onto the material to provide the necessary connection points 104, 105 (FIG. 13). The window treatment 106 of FIG. 14 includes two such swags 100 and two rosettes with bells 108. This particular window treatment 106 can be attached using method A, B, C, or D described earlier. To create the swag, connection points 104 are all connected to each other starting from one end and connecting the next closest point as is shown in FIGS. 3, 5, and 6, and connection points 105 are also connected to each other in the same fashion. This is the preferred method of connecting the points in creating swags, valances, and jabots.

Figure 15:
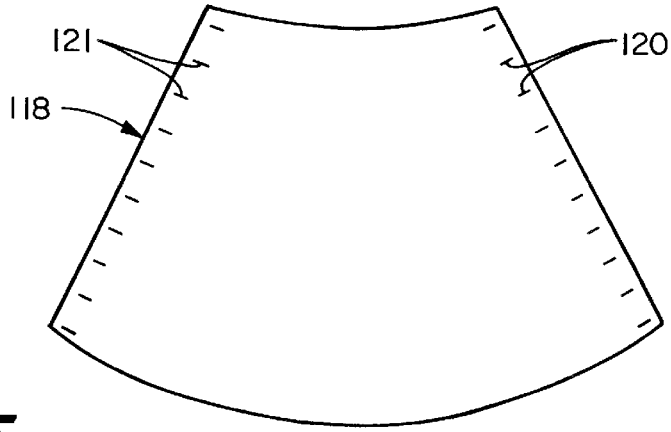
FIG. 15 is a top plan view of a piece of material formed using the template of the present invention.
Figure 16:
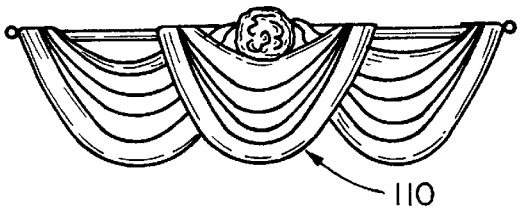
FIG. 16 is a front elevational view of a window treatment created using three pieces of material identical to FIG. 15 with an added rosette.
Figure 17:
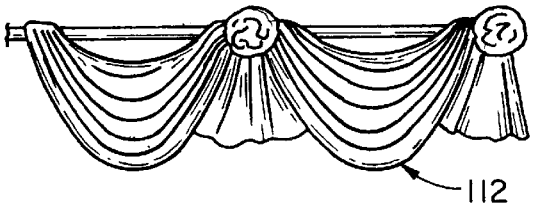
FIG. 17 is a front elevational view of another type of window treatment created using two pieces of material identical to FIG. 15 with an addition of two rosettes with bells.
Figure 18:
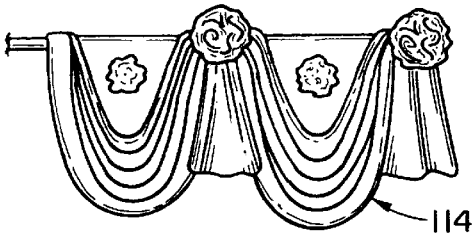
FIG. 18 is a front elevational view of still another type of window treatment created using two pieces of material identical to FIG. 15, two rosettes with bells, and two filler aprons.
Figure 19:
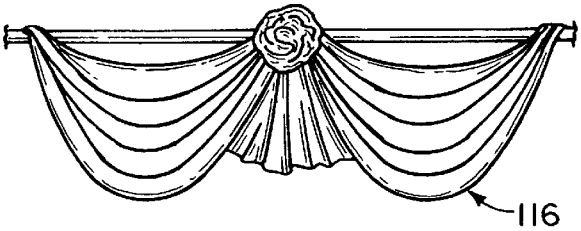
FIG. 19 is a front elevational view of yet another type of window treatment created using two pieces of material identical to FIG. 15 and a rosette with a bell.

FIGS. 15–19 illustrate another type of a traditional swag that can be created using the templates 10, 20 of the present invention and are attached to a curtain rod using methods A, B, C, D or J described earlier. The swags or valance arrangements 110, 112, 114, 116 shown in FIGS. 16–19 are created using the form 118 shown in FIG. 15. The material is cut from using points 14*a*, 14*b*, 16*a*, and 16*b* from template 10 or using points 24*a*, 24*b*, 26*a*, and 26*b* from template 20. These points are marked onto the swag material to provide the necessary incision points 120, 121 (FIG. 15).

Figure 20:
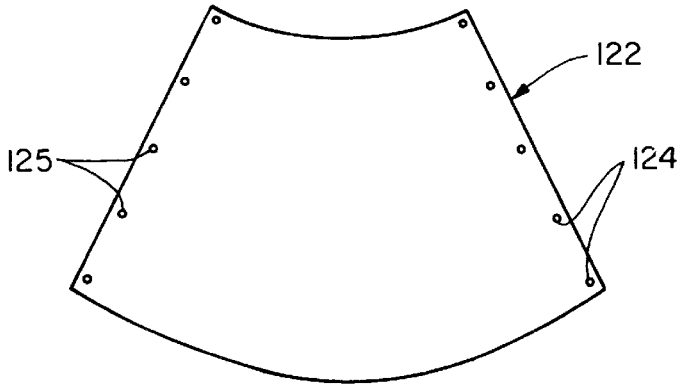
FIG. 20 is a top plan view of a piece of material formed using the template of the present invention.
Figure 21:
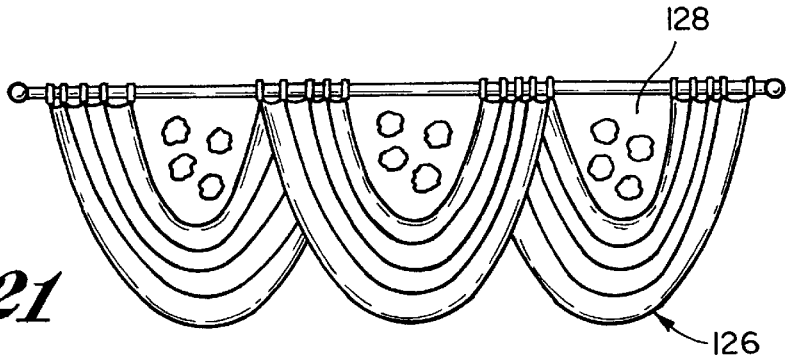
FIG. 21 is a front elevational view of a window treatment created using three pieces of fabric identical to FIG. 20 and three filler aprons.
Figure 22:
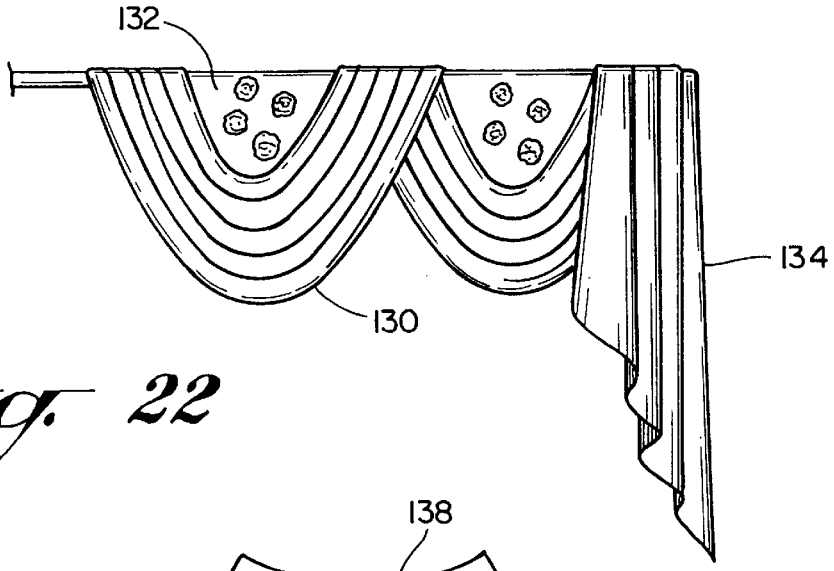
FIG. 22 is a front elevational view of another window treatment created using two pieces of fabric identical to FIG. 20 and two filler aprons and a jabot.

The form cut out 122 in FIG. 20 is traced from the template 10 using connection points 12*c* and 12*d*, and cutout lines 16*b* and 16*c* and provides marked points 124, 125 for connection. The resulting swag 126 using attachment method E is shown in FIG. 21 with a filler apron 128. FIG. 22 shows what the resulting swag 130 would further look like if attached using method F, G, H or I. FIG. 22 further includes filler aprons 132 and a jabot 134.

Figure 23:
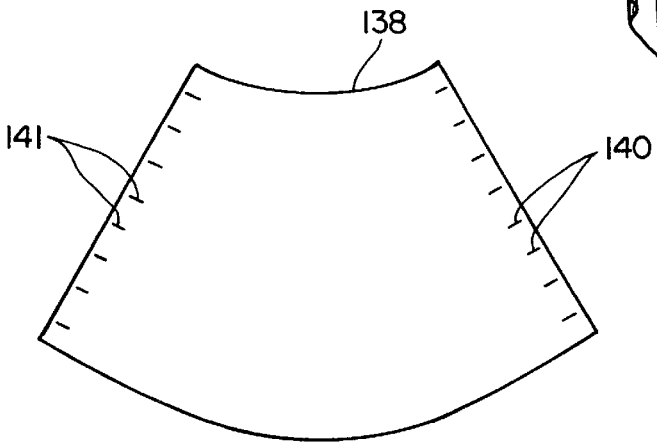
FIG. 23 is a top plan view of a piece of material formed using the template of the present invention.
Figure 24:
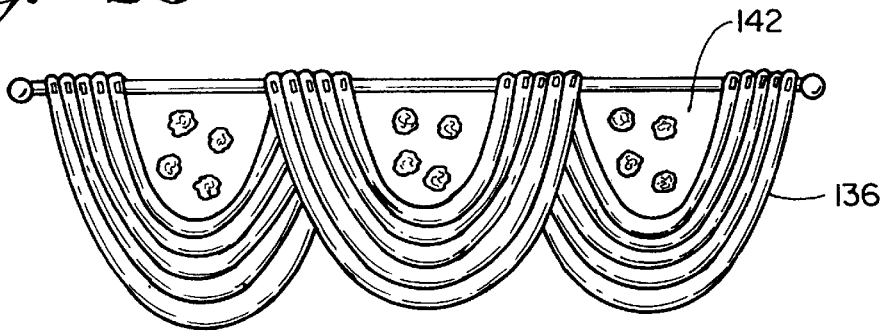
FIG. 24 is a front elevational view of a window treatment created using three pieces of fabric identical to FIG. 23 and three filler aprons.
Figure 25:
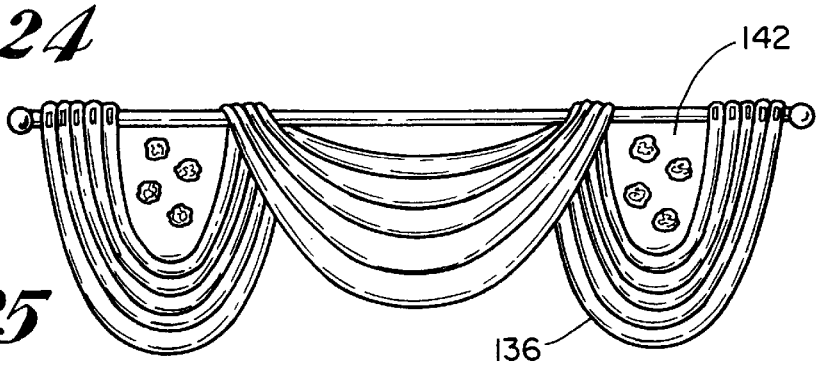
FIG. 25 is a front elevational view of another window treatment created using three pieces of fabric identical to FIG. 23 and two filler aprons.

FIGS. 23–25 illustrate the formation of a swag 136 using method J as described earlier in this application. The material 138 is cut from the template 10 using incision points 14*c* and 14*d*, and cutout lines 16*b* and 16*c*, and provides marked incision points 140, 141. The resulting valance arrangements as shown in the Figures includes filler aprons 142 for decorative purposes.

Figure 26:
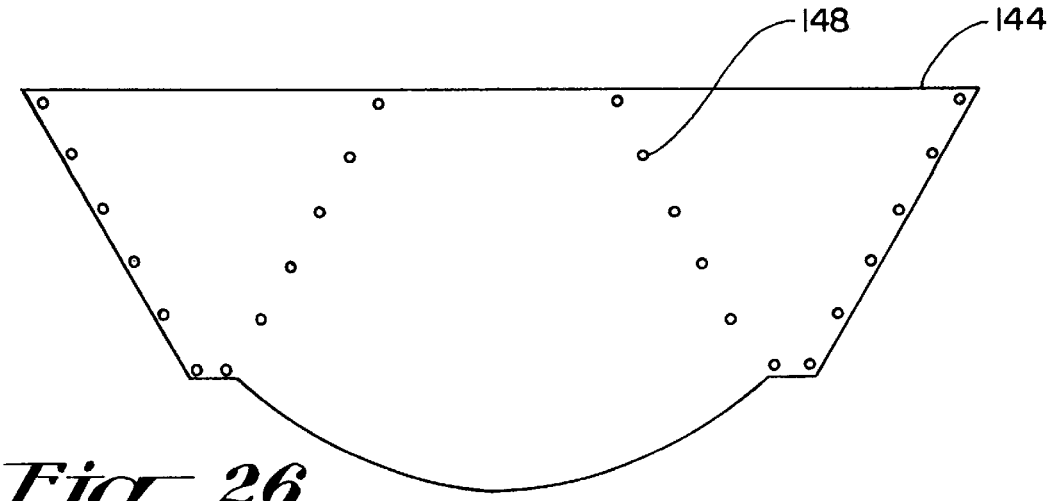
FIG. 26 is a top plan view of a piece of material formed using the template of the present invention.
Figure 27:
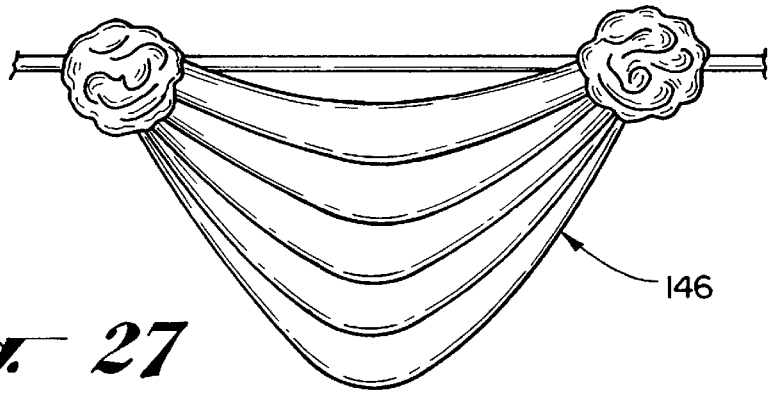
FIG. 27 is a front elevational view of a window treatment created using the sized piece of fabric shown in FIG. 26.

If one desires to create a swag with rosettes, FIGS. 26 and 27 illustrates the form used to create such a swag 146. Connection points 12*a*, 12*b*, 12*e*, and 12*f* are marked onto the fabric 144 from the template 10 (FIG. 1) as well as cutout lines 16*b*. One can also use template 20 (FIG. 2) to create this form by shifting the template to the left and to the right of the marked connection points marking the appropriate points. The material is then cut along the outer edges of the marked connection points made from the template 10 from points 12*e*, cutout lines 16*b*, and points 12*f*. Each individual row of the points 148 are then connected using method A, B, C or D. The resulting swag with rosettes 146 is shown in FIG. 27.

Figure 28:
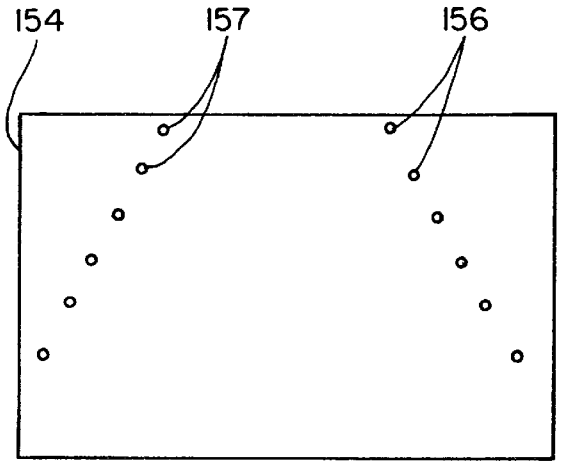
FIG. 28 is a top plan view of a piece of fabric formed from the template of the present invention.
Figure 29:
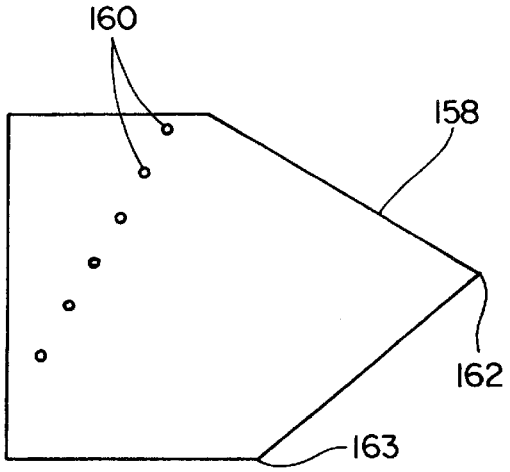
FIG. 29 is a top plan view of another piece of fabric formed from the template of the present invention.
Figure 30:
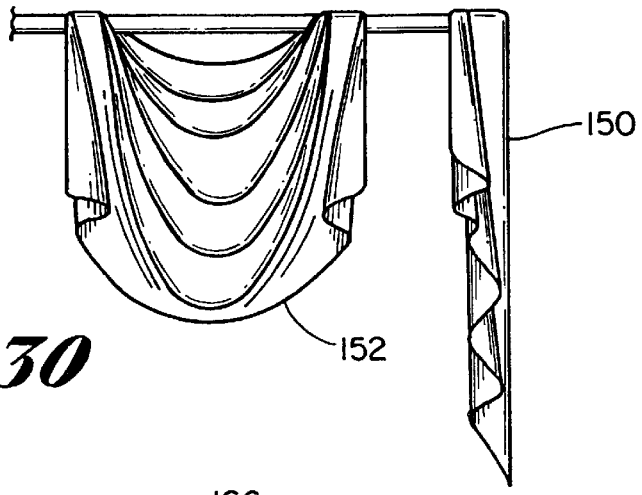
FIG. 30 is a front elevational view illustrating the type of swag (FIG. 28) and jabot (FIG. 29) that can be created using the pieces of fabric shown in FIGS. 28 and 29.
Figure 31:
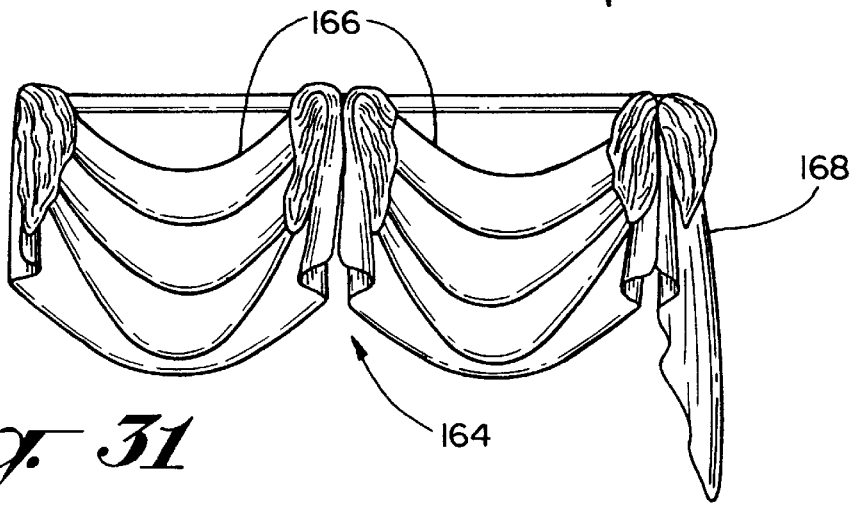
FIG. 31 is a front elevational view of a window treatment created using two pieces of material identical to FIG. 28 and a piece of material identical to FIG. 29.

FIGS. 30 illustrates ajabot 150 and a swag 152 made from the pieces constructed from the template as shown in FIGS. 28 and 29. The swag 152 in this instance is constructed from a standard piece of rectangular fabric 154 with connection points 156, 157 marked from template 10 or template 20 (FIGS. 1 and 2). The jabot 150 is created using the template 10 by marking connection points 12*f*, 12*k*, 12*l*, 12*m*, 12*n*, and 12*p*. The resulting piece of fabric 158 is cut around points 12*k*, 12*l*, 12*m*, 12*n*, and 12*p*, leaving marked points 160 from connection points 12*f* of the template 10. This piece of material 158 can also be created using template 20 (FIG. 2), wherein two of the comer edges 162, 163 are simply perpendicular lines taken from the two ends of marked points 160. FIGS. 31 illustrates an additional window treatment 164 one can create using the material pieces of FIGS. 28 and 29, wherein the swags 166 are made from the piece of material 154 in FIG. 28 and the jabot 168 is made from the piece of material 158 in FIG. 29. The window treatments shown in FIGS. 28 and 29 can be attached using methods A, B, C, or D described earlier.

Figure 32:
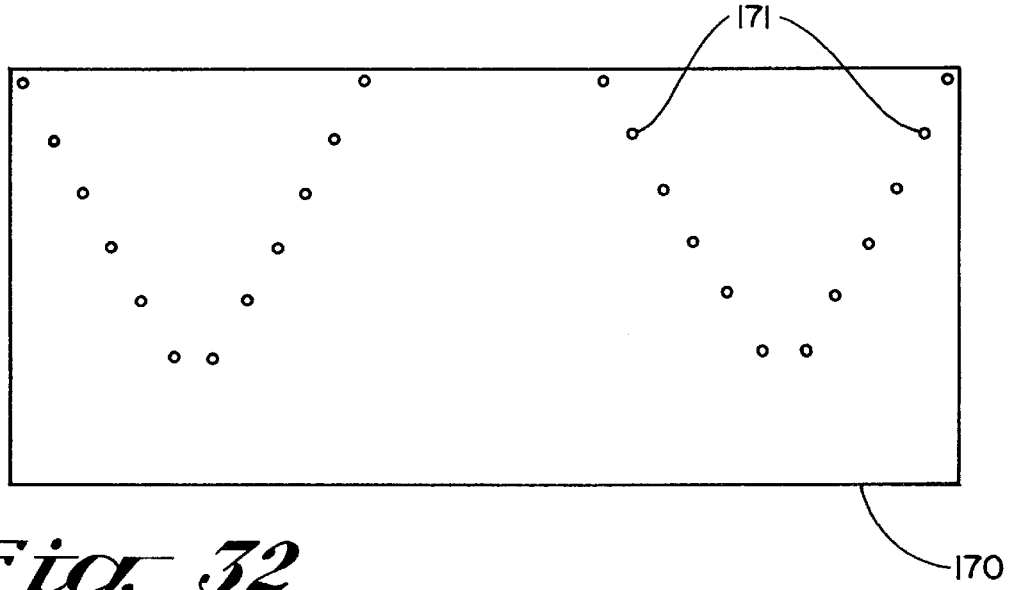
FIG. 32 is a top plan view of a piece of material with marked points formed using the template of the present invention.
Figure 33:
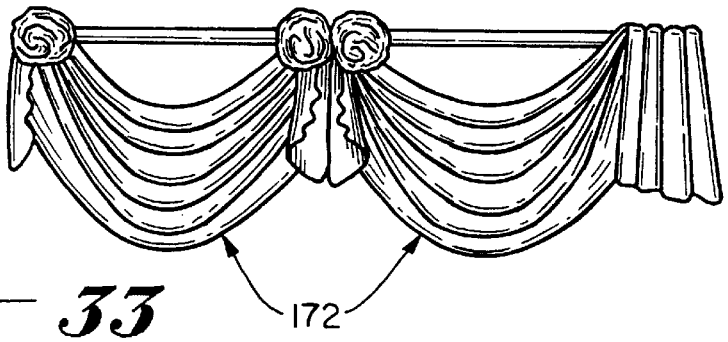
FIG. 33 is a front elevational view of a window treatment created using two pieces of fabric identical to FIG. 32.

FIG. 32 is a rectangular piece of material 170 formed from the template 10, 20 by using connection points 12*a*, 12*b*, 12*e*, and 12*f*; or connection points 22*a* and 22*b*, resulting in marked points 171. This piece of material 170 enables one to create a swag with rosettes and bells 172 shown in FIG. 33. This swag is created by separately connecting each row of marked connection points together. This particular window treatment can be attached using methods A, B, C, or D.

Figure 34:
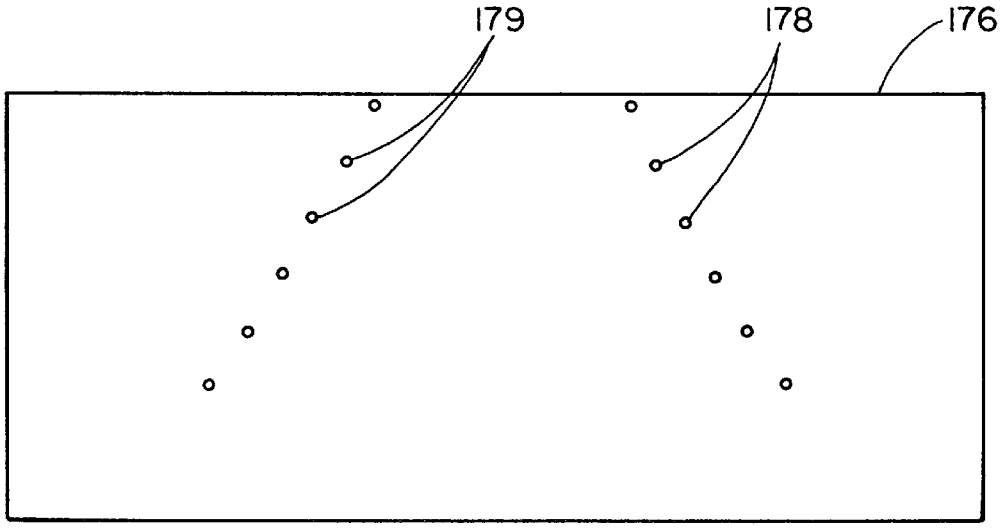
FIG. 34 is a top plan view of a piece of material with marked points formed using the template of the present invention.
Figure 35:
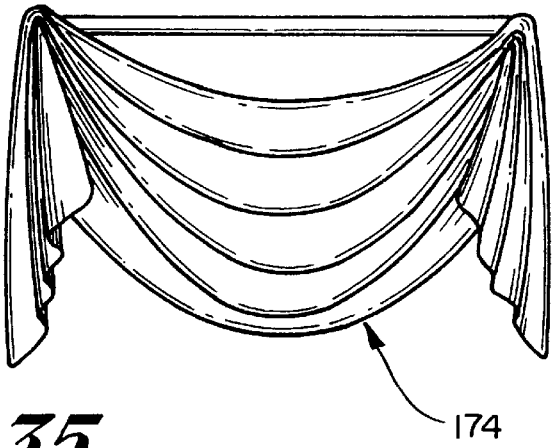
FIG. 35 is a front elevational view of a swag created using the fabric shown in FIG. 34.

FIG. 35 illustrates yet another window treatment 174 (swag with cascades) created using the templates 10, 20 of the present invention. The window treatment 174 is created using the piece of material 176 illustrated in FIG. 34 and connecting marked connection points 178, 179 together. The window treatment shown in FIG. 35 can be attached using methods A, B, C, or D.

Figure 36:
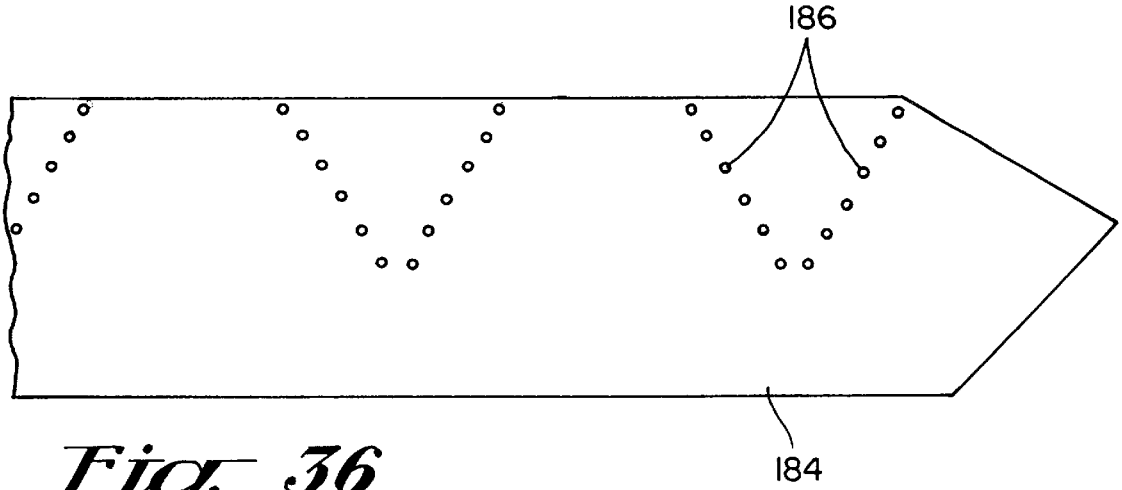
FIG. 36 is a partial top plan view of a piece of fabric with marked points made from the template of the present invention.
Figure 37:
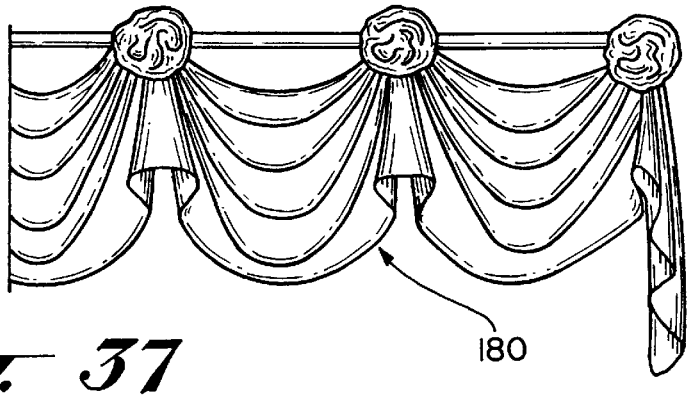
FIG. 37 is a partial front elevational view illustrating the window treatment created using the piece of fabric of FIG. 36.
Figure 38:
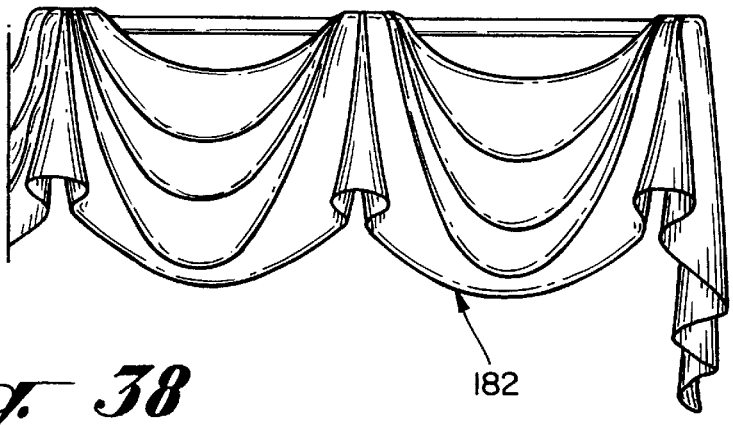
FIG. 38 is a partial front elevational view illustrating another method of hanging the window treatment shown in FIG. 37 wherein the rosettes are tucked behind the curtain rod.

FIGS. 37 and 38 illustrate valances 180, 182 that can be created using the sheet of material 184 shown in FIG. 36. This sheet of material can be created and marked from the templates 10, 20 of the present invention. In this particular instance, one can shift the template on the fabric 184 as many times as is desired to create a valance with a plurality of swags, bells, and rosettes if desired. The marked connection points 186 can be connected using methods A, B, C, or D. The valance 182 in FIG. 38 is created without rosettes by tucking the additional material from the fabric 184 behind the curtain rod and the valance in order to achieve a different valance decoration.

Figure 39:
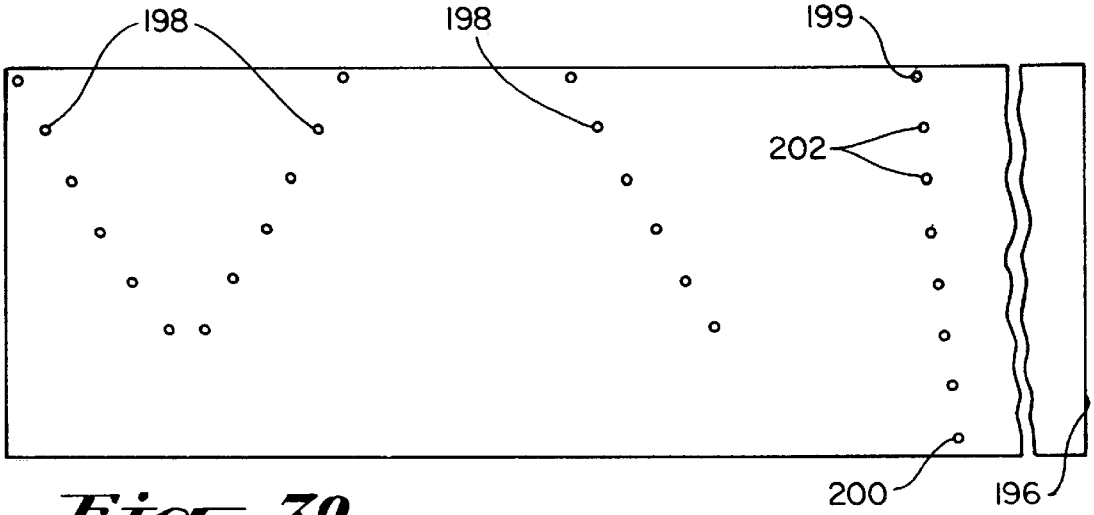
FIG. 39 is a top plan view of a piece of fabric with marked points made from the template of the present invention with cafe clips attached thereon.
Figure 40:
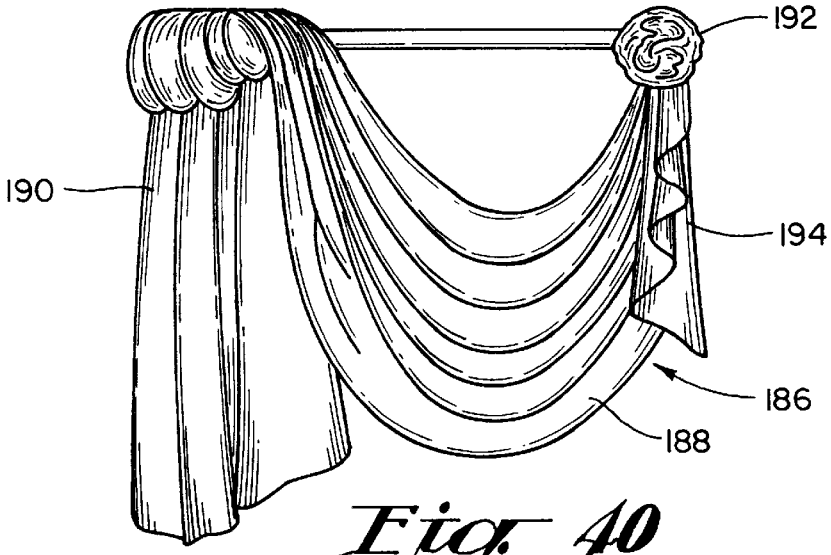
FIG. 40 is a front elevational view of the window treatment created using the piece of fabric of FIG. 39.
Figure 41:
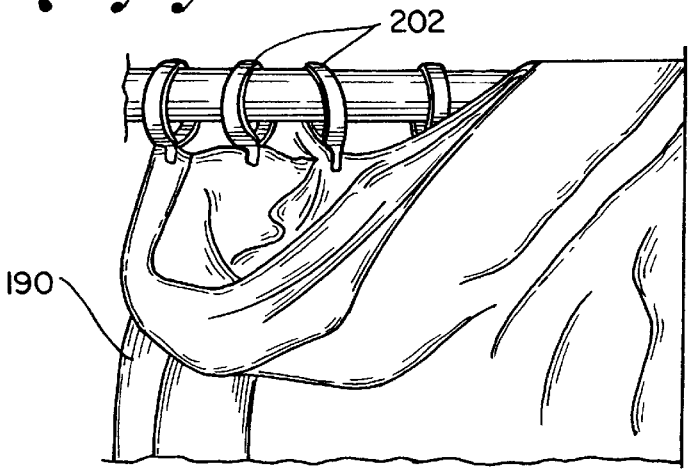
FIG. 41 is a partial front elevational view illustrating how the cafe clips in FIGS. 39 and 40 are attached to a curtain rod.

FIGS. 39 through 41 illustrate the construction of a window treatment 186 having a swag 188 with a wrap-around jabot 190 and a rosette 192 with a bell 194. A piece of fabric 196 is cut to a rectangular size using template 10 or it can also be created using template 20 by shifting the template on the fabric. Connection points 12*a*, 12*b*, 12*e*, 12*l* and 12*n* from the template 10 are marked onto the fabric creating marked points 198, 199, 200. A plurality of café clips 202 are attached an equal distance apart along a line between marked points 199 and 200. The marked points 198 made from connection points 12*a*, 12*b*, and 12*e* are attached using method A, B, C or D. The cafe clips are attached in a fashion similar to method E and a portion of the fabric is wrapped over the café clips to create a wrap around jabot 190. The resulting window treatment 186 is shown in FIG. 40.

Figure 42:
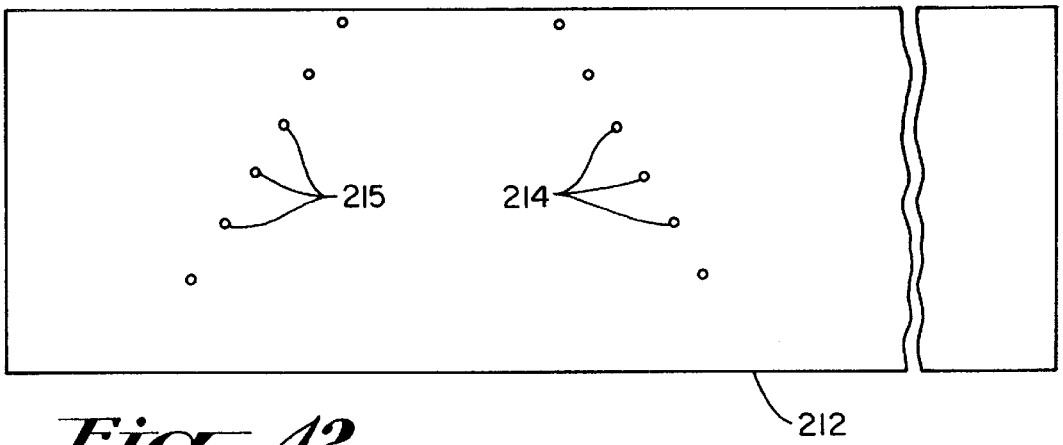
FIG. 42 is a top plan view of a piece of fabric with marked points made from the template of the present invention.
Figure 43:
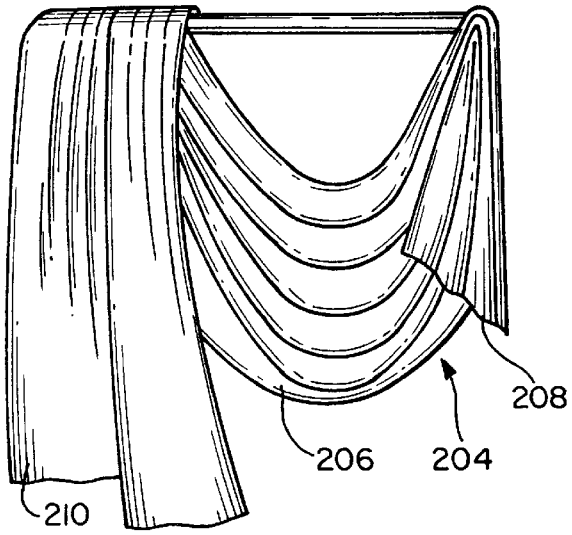
FIG. 43 is a front elevational view of a window treatment created using the piece of fabric of FIG. 42.

FIGS. 42 and 43 illustrate the construction of a window treatment 204 comprising a swag 206 with a cascade 208 and a straight jabot 210. A piece of fabric 212 is cut to the approximately to the size of the rectangular template 10, or it can be marked using template 20, and connection points 12*a* and 12*b* from template 10, or connection points 22*a* and 22*b* from template 20 are marked onto the fabric 212 creating marked points 214, 215. The marked points are attached using method A, B, C or D and the extra piece of fabric is draped over one side to create a straight jabot 210. The window treatment 204 shown in FIG. 43 is then easily created and attached to a window frame.

Various different common accessories can be added to a window treatment such as rosettes with or without bells, filler aprons and curtain rod covers in order to make the window treatment more decorative. The templates 10, 20 of the present invention (FIGS. 1 and 2) allow for one to also quickly and easily create these accessories.

Figure 44:
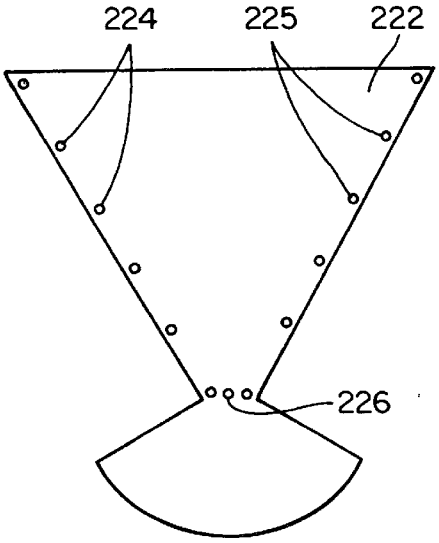
FIG. 44 is a front view of a piece of fabric formed using the template of the present invention.
Figure 45:
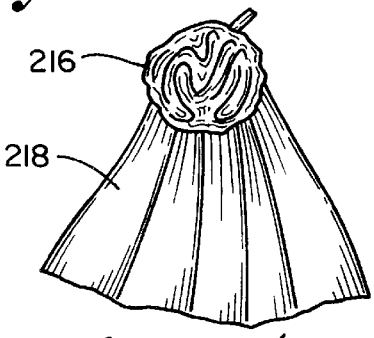
FIG. 45 is a front view of a rosette with a bell created using the piece of fabric of FIG. 44.
Figure 54:
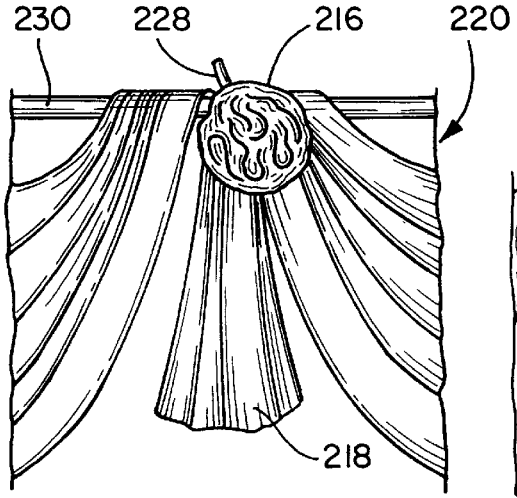
FIG. 54 is a partial front elevational view illustrating the attachment of the hook and loop fastener to a curtain rod.

FIGS. 44, 45 and 54 show how a rosette 216 with a bell 218 is created and installed onto a window treatment 220. A piece of fabric 222 is cut out using connection points 12*b*, 12*f*, and 12*o* and cutout line 16*e* from template 10 to form the piece of material 222 shown in FIG. 44. The connection points are marked onto the material as marked points 224, 225, 226. The rosette 216 with the bell 218 (FIGS. 45 and 54) is created by using attachment method A, B, C or D described above wherein all of the marked points are connected together using only one connector, such as a safety pin or pin-on hook. The rosette with bell (FIG. 54) can then be attached with a hook and loop fastener 228 (attachment method A) or any other means, such as attachment methods B, C, or D, to a curtain rod 230.

Figure 46:
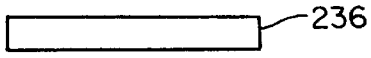
FIG. 46 is a front view of a piece of fabric formed using the template of the present invention.
Figure 47:
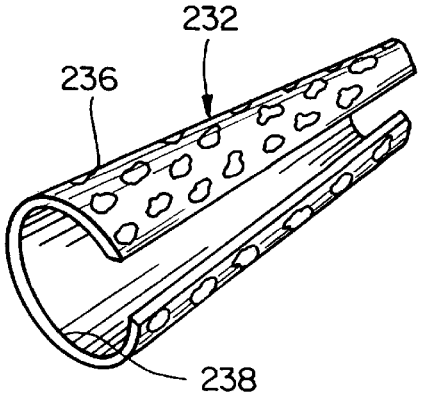
FIG. 47 is a partial perspective view of a filler hardware cover using the piece of fabric of FIG. 46.
Figure 55:
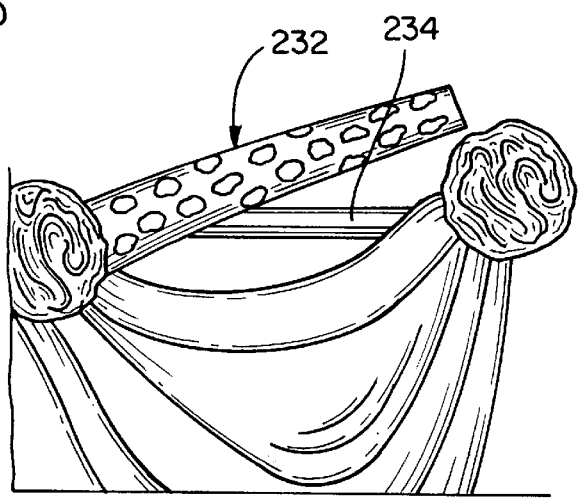
FIG. 55 is a partial front elevational view illustrating the method of attaching a decorative curtain rod cover over a curtain rod.

FIGS. 46, 47 and 55 show how to create and install a decorative hardware cover 232. The decorative hardware cover can be placed onto exposed areas on a curtain rod 234 (FIG. 55)in order to create a more decorative window treatment. The fabric 236 desired to be used for the hardware cover is cut out using connection points 12*t* and 12*u* on the template 10 to form a rectangular piece of material 236 (FIG. 46) approximately the length of exposed curtain rod area 234. The material 236 (FIG. 47) is then secured to a piece of semi-flexible tube material 238, such as plastic or synthetic foam having an opening along its length, thereby creating a hardware filler cover 232. The filler cover 232 can then be placed over the exposed curtain rod to provide a decorative appearance.

Figure 48:
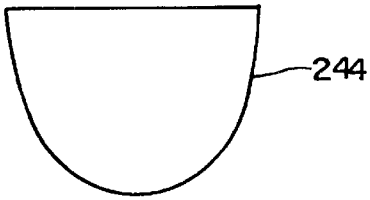
FIG. 48 is a front view of another piece of fabric formed using the template of the present invention.
Figure 49:
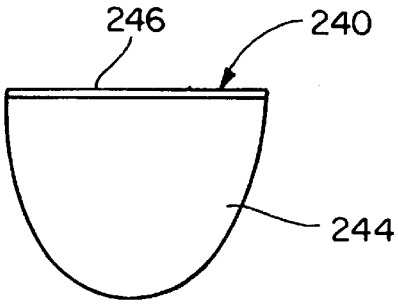
FIG. 49 is a front view of a filler apron formed using the piece of fabric of FIG. 48.
Figure 56:
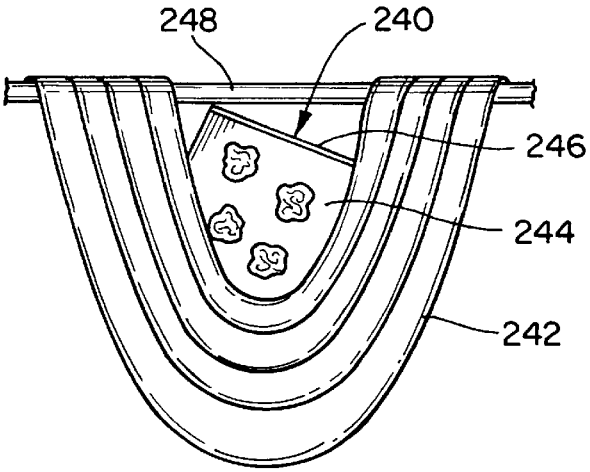
FIG. 56 is a front elevational view illustration the method of attaching a filler apron onto a curtain rod containing a swag.

FIGS. 48, 49 and 56 show how to create and install a filler apron 240. The filler apron is used to fill a gap created in a middle of a swag 242 (FIG. 56) to create a different type of decorative appearance. The filler apron can have various designs placed thereon. The filler apron is cut out from the form presented on the template 10 along cutout lines 16*d* and across connection points 12*u* to form a piece of material 244 as shown in FIG. 48. The filler apron 240 can have an attachment strip 246 (hook and loop fastener or other type of fastener) secured along its upper edge (FIGS. 49, 56) to make it easier to attach the filler apron onto a curtain rod 248.

Figure 50:
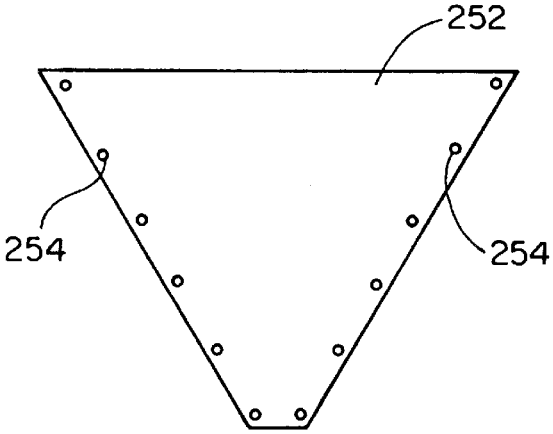
FIG. 50 is a front view of still another piece of fabric formed using the template of the present invention.
Figure 51:
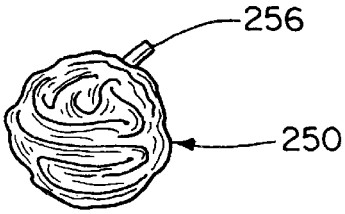
FIG. 51 is a front view of a rosette created using the piece of fabric of FIG. 50.
Figure 52:
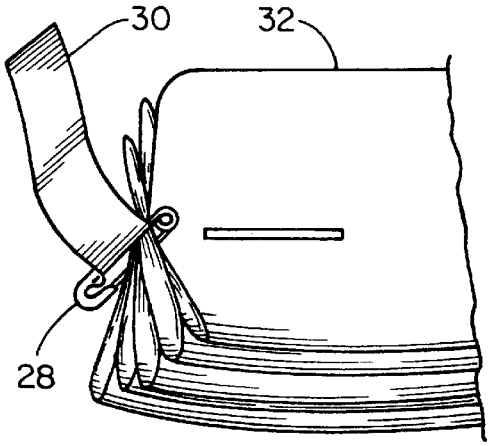
FIG. 52 is a partial perspective view illustrating how the connection points on the material are connected with a safety pin.
Figure 53:
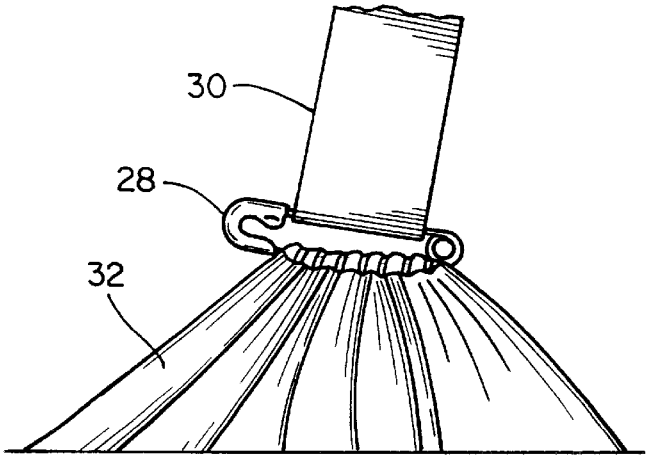
FIG. 53 is a partial perspective view illustrating another method of attaching a safety pin through connection points that are tacked with thread on the material.

FIGS. 50 and 51 illustrate how to create only a rosette 250. A piece of fabric 252 is cut out similar to FIG. 50 but does not include the lower bell portion. This piece can be created from either template 10, 20 from FIGS. 1 and 2. The marked connection points 254 are attached using method A, B, C or D described above. The rosette 250 can then be attached to a window treatment using the attached connector 256.

Either one of the templates 10, 20 described herein enable one to create numerous different types of window treatments and accessories quickly and easily without having prior experience and without having the help of a professional. The templates can also be modified not only in different sizes, but to include only a select amount of connection points, incision points, and cutout lines. Connection points 12*h*, 12*i*, 12*j*, 12*k*, 12*p*, 12*q*, 12*r*, and 12*s* on template 10 (FIG. 1) can be used for reference purposes in order to make it easier for a user to shift the template on a piece of fabric and to make sure a proper space is created in between each swag on a valance.

The decorative window treatments that can be made using the present invention can also be made by doubling the material (e. g. back to back) to allow for changeable decorative appearances (e. g. different colors, textures, patterns). Furthermore, each of the connection points on the fabric can be tacked with thread to obtain a method of connecting both fabrics together at each connection point so that the fabrics do not shift.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A template used for making swags, valances, jabots, and window treatment accessories, said template comprising a sheet of material, the sheet of material having first and second spaced curved rows of perforations, said first curved row of perforations being positioned above said second curved row of perforations with said second curved row of perforations being longer in length than said first curved row of perforations, said first and second curved rows of perforations being spaced apart and being curved in a downwardly direction, a first pair of straight connecting rows of perforations having equal lengths are positioned on said sheet of material to intersect opposite ends of said spaced curved rows of perforations, each of said straight connecting rows of perforations comprising a plurality of equally spaced apertures, the pair of straight connecting rows of perforations extending in a direction away from each other and down from said first curved row of perforations to said second curved row of perforations, said template further comprises a third curved row of perforations, said third curved row of perforations being positioned slightly below said first curved row of perforations and above said second curved row of perforations, said third curved row of perforations being shorter in length than said first curved row of perforations, said third curved row of perforations being spaced apart from said second curved row and being curved in the downwardly direction, a second pair of straight connecting rows of perforations having equal lengths being positioned on said sheet of material to intersect opposite ends of said second and third curved rows of perforations, each of said second pair of straight connecting rows of perforations comprising a plurality of equally spaced slots, said second pair of straight connecting rows of perforations extending in a direction away from each other and down from said third curved row of perforations to said second curved row of perforations, whereby a user can place the template onto the sheet of material and mark desired points onto the sheet of material to allow the user to create at least one swag or a jabot with the sheet of material.

2. A template according to claim 1, wherein said template further comprises a third straight connecting row of perforations, said third straight connecting row of perforations being positioned a predetermined distance next to a first row of the first pair of straight connecting rows of perforations, said third straight connecting row of perforations being equal in length and having the same angle as a second row of the first pair of straight connecting rows of perforations, wherein said third straight connecting row of perforations extends in a direction upward and away from said first row, whereby a user can create additional window treatments and accessories with the template.

3. A template according to claim 1, wherein said template further comprises a third straight connecting row of perforations, said third straight connecting row of perforations being positioned a predetermined distance next to a first row of the first pair of straight connecting rows of perforations, said third straight connecting row of perforations being equal in length and having the same angle as a second row of the first pair of straight connecting rows of perforations, wherein said third straight connecting row of perforations extends in a direction upward and away from said first row, and a first and second jabot connecting point, said first jabot connecting point being positioned a predetermined distance away from said third straight connecting row of perforations at an angle perpendicular to an uppermost slit in said third straight connecting row of perforations, said second jabot connecting point being positioned a predetermined distance away from said third straight connecting row of perforations at an angle perpendicular to a lowermost slit in said third straight connecting row of perforations, said first jabot connecting point being a longer distance from said third straight connecting row of perforations than said second jabot connecting point, whereby a user can create decorative jabots.

4. A template according to claim 1, wherein said template further comprises a U-shaped curved row of perforations, said U-shaped curved row being positioned in between said first and second spaced curved rows of perforations and in between said first pair of straight connecting rows of perforations, whereby a user can create a filler apron as an accessory to a window treatment.

5. A template according to claim 1, wherein said template further comprises four hardware cover points, said hardware cover points being positioned in between said first and second spaced curved rows of perforations and in between said first pair of straight connecting rows of perforations, said four hardware cover points being sized in the shape of a rectangle, wherein said four hardware cover points allow a user to cut a piece of fabric for providing a decorative appearance to a hardware cover for use with window treatments.

6. A template according to claim 1, wherein said straight connecting rows of perforations have alternating configurations comprising equally spaced circular shapes and equally spaced elongated slotted shapes.

7. A template according to claim 1, wherein said template is made of a material selected from the group consisting of: plastic, transparent plastic, fabric, vinyl, and paper.

8. A template according to claim 1, wherein said template has a rectangular configuration.

9. A template used for making swags, valances, jabots, and window treatment accessories, said template comprising a sheet of material, the sheet of material having first and second spaced curved rows of perforations, said first curved row of perforations being positioned above said second curved row of perforations with said second curved row of perforations being longer in length than said first curved row of perforations, said first and second curved rows of perforations being spaced apart and being curved in a downwardly direction, a pair of straight connecting rows of perforations having equal lengths are positioned on said sheet of material to intersect opposite ends of said spaced curved rows of perforations, each of said straight connecting rows of perforations comprising a plurality of equally spaced apertures, the pair of straight connecting rows of perforations extending in a direction away from each other and down from said first curved row of perforations to said second curved row of perforations, said template further comprises a third straight connecting row of perforations, said third straight connecting row of perforations being positioned a predetermined distance next to a first row of the pair of straight connecting rows of perforations, said third straight connecting row of perforations being equal in length and having the same angle as a second row of the pair of straight connecting rows of perforations, wherein said third straight connecting row of perforations extends in a direction upward and away from said first row, and a first and second jabot connecting point, said first jabot connecting point being positioned a predetermined distance away from said third straight connecting row of perforations at an angle perpendicular to an uppermost slit in said third straight connecting row of perforations, said second jabot connecting point being positioned a predetermined distance away from said third straight connecting row of perforations at an angle perpendicular to a lowermost slit in said third straight connecting row of perforations, said first jabot connecting point being a longer distance from said third straight connecting row of perforations than said second jabot connecting point, whereby a user can place the template onto a sheet of material and mark desired points onto the sheet of material to allow the user to create at least one swag or a jabot with a sheet of material.

10. A template according to claim 9, wherein said template further comprises a third curved row of perforations, said third curved row of perforations being positioned slightly below said first curved row of perforations and above said second curved row of perforations, said third curved row of perforations being shorter in length than said first curved row of perforations, said third curved row of perforations being spaced apart from said second curved row and being curved in the downwardly direction, a second pair of straight connecting rows of perforations having equal lengths being positioned on said sheet of material to intersect opposite ends of said second and third curved rows of perforations, each of said second pair of straight connecting rows of perforations comprising a plurality of equally spaced slots, said second pair of straight connecting rows of perforations extending in a direction away from each other and down from said third curved row of perforations to said second curved row of perforations, whereby a user can create different types of swags with a sheet of material.

11. A template according to claim 9, wherein said template further comprises a U-shaped curved row of perforations, said U-shaped curved row being positioned in between said first and second spaced curved rows of perforations and in between said pair of straight connecting rows of perforations, whereby a user can create a filler apron as an accessory to a window treatment.

12. A template according to claim 9, wherein said template further comprises four hardware cover points, said hardware cover points being positioned in between said first and second spaced curved rows of perforations and in between said pair of straight connecting rows of perforations, said four hardware cover points being sized in the shape of a rectangle, wherein said four hardware cover points allow a user to cut a piece of fabric for providing a decorative appearance to a hardware cover for use with window treatments.

13. A template according to claim 9, wherein said straight connecting rows of perforations have alternating configurations comprising equally spaced circular shapes and equally spaced elongated slotted shapes.

14. A template according to claim 9, wherein said template further comprises a third curved row of perforations, said third curved row being positioned centrally below said first and third straight connecting rows, said third curved row being curved in the downwardly direction, wherein said third curved row and said first and third straight connecting rows allow a user to mark points on a piece of fabric and create a rosette with a bell as an accessory to a window treatment.

* * * * *